US006796190B2

(12) United States Patent
Curry

(10) Patent No.: US 6,796,190 B2
(45) Date of Patent: Sep. 28, 2004

(54) ELECTRONIC TORQUE WRENCH WITH FLEXIBLE HEAD

(75) Inventor: David D. Curry, Kenosha, WI (US)

(73) Assignee: Snap-on Incorporated, Pleasant Prairie, WI (US)

( * ) Notice: Subject to any disclaimer, the term of this patent is extended or adjusted under 35 U.S.C. 154(b) by 0 days.

(21) Appl. No.: 10/368,032

(22) Filed: Feb. 19, 2003

(65) Prior Publication Data

US 2004/0159164 A1 Aug. 19, 2004

(51) Int. Cl.[7] ..... B25B 23/14
(52) U.S. Cl. ..... 73/862.21
(58) Field of Search ..... 73/862.191, 862.21, 73/862.22, 862.25

(56) References Cited

U.S. PATENT DOCUMENTS

| | | | | |
|---|---|---|---|---|
| 3,769,860 A | | 11/1973 | Frings et al. | |
| 4,643,030 A | | 2/1987 | Becker et al. | |
| 4,669,319 A | | 6/1987 | Heyraud | |
| 4,864,841 A | | 9/1989 | Heyraud | |
| 4,958,541 A | | 9/1990 | Annis et al. | |
| 4,976,159 A | | 12/1990 | Snyder et al. | |
| 4,982,612 A | | 1/1991 | Rittmann | |
| 5,130,700 A | | 7/1992 | Annis et al. | |
| 5,172,616 A | | 12/1992 | Negishi | |
| 5,404,775 A | | 4/1995 | Abe | |
| 5,589,644 A | * | 12/1996 | Becker et al. | 73/862.23 |
| 5,617,766 A | | 4/1997 | Tsuji et al. | |
| 5,662,012 A | * | 9/1997 | Grabovac | 81/483 |
| 5,862,723 A | | 1/1999 | Rowlands | |
| 5,890,406 A | | 4/1999 | Thorn | |
| 6,000,302 A | | 12/1999 | Chiang | |
| 6,070,506 A | | 6/2000 | Becker | |
| 6,119,559 A | | 9/2000 | Zerver | |
| 6,119,562 A | * | 9/2000 | Jenkins | 81/479 |
| 6,196,071 B1 | | 3/2001 | Shomo | |
| 6,220,125 B1 | | 4/2001 | Lan | |
| 6,405,621 B1 | | 6/2002 | Krivec et al. | |
| 6,463,811 B1 | * | 10/2002 | Putney | 73/862.21 |

* cited by examiner

*Primary Examiner*—Max Noori
(74) *Attorney, Agent, or Firm*—Seyfarth Shaw LLP

(57) ABSTRACT

An electronic torque wrench has a lever arm pivotally coupled to a head member which is adapted for coupling to an associated fastener for rotation therewith about the rotational axis thereof, a torque sensing device being disposed on the head member for movement therewith relative to the lever arm. Different embodiments are provided for different degrees of relative angular movement between the head member and the lever arm.

25 Claims, 4 Drawing Sheets

ELECTRONIC TORQUE WRENCH WITH FLEXIBLE HEAD

BACKGROUND

This application relates to torque applying and measuring apparatus and, in particular, to electronic torque wrenches. The application relates specifically to indexable torque wrenches.

Typically, torque wrenches, such as electronic torque wrenches, provide an elongated lever arm with a coupling mechanism, such as a drive lug, on a coupling head fixed at an end of the lever arm and disposed for coupling to an associated socket tool, fastener or other device to be torqued. In a typical arrangement, the coupling device includes a drive lug projecting from the lever arm substantially perpendicular thereto. U.S. Pat. No. 4,643,030 discloses such an arrangement, wherein the torque sensing means comprises a strain gauge assembly disposed on the coupling head and connected by suitable electrical connections to display apparatus carried by the lever arm. In many cases, in using such a fixed-head wrench, a universal joint or the like is required between the head and the fastener in order to reach the fastener. This decreases the accuracy of the measurement.

It is also known to provide indexable torque wrenches, wherein the coupling head is indexable or pivotally movable relative to the lever arm to facilitate access to fasteners in certain applications, such a wrench being disclosed, for example, in U.S. Pat. No. 4,958,541. In such wrenches the torque sensing means, such as a strain gauge assembly, is located on the lever arm.

SUMMARY

This application discloses improved torque wrenching techniques which avoid disadvantages of prior techniques while affording additional structural and operating advantages.

An aspect of the disclosed technique is the provision of an indexable-head torque wrench which affords accurate torque measurement.

In connection with the foregoing aspect another aspect is provision of an indexable-head torque wrench wherein the accuracy of the torque measurement is enhanced.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

DETAILED DESCRIPTION

Figure 1:
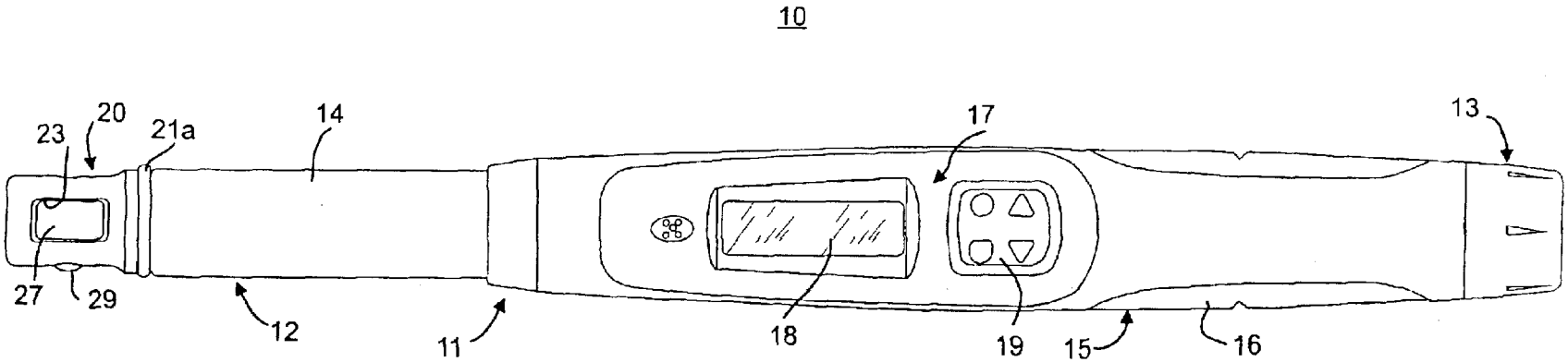
FIG. 1 is a top plan view of a first embodiment of torque wrench.

Referring to FIGS. 1–4, there is illustrated an electronic torque wrench, generally designated by the numeral 10, having an elongated lever arm 11 with a working end 12 and a handle end 13. The lever arm 11 includes an elongated, substantially tubular shaft 14 and a housing 15 mounted on the shaft 14 and enclosing approximately the rear two-thirds thereof. The housing 15 may be of generally two-part construction and may be provided with a handle grip 16. Mounted in the housing 15 may be a user interface 17, including a suitable display 18, which may be a digital electronic display, and a control keypad 19. The lever arm 11, the housing 15 and the circuitry and structure disposed within the housing 15 may be substantially the same as that disclosed in the copending U.S. application Ser. No. 10/293,006, filed Nov. 13, 2002, and entitled "Electronic Torque Wrench," the disclosure of which is incorporated herein by reference.

Figure 2:
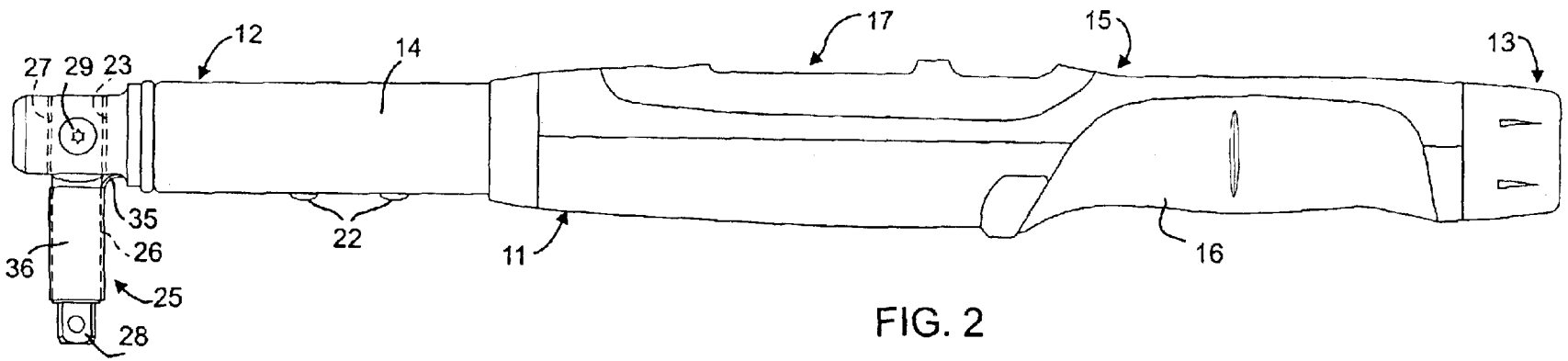
FIG. 2 is a side elevational view of the torque wrench of FIG. 1.
Figure 3:
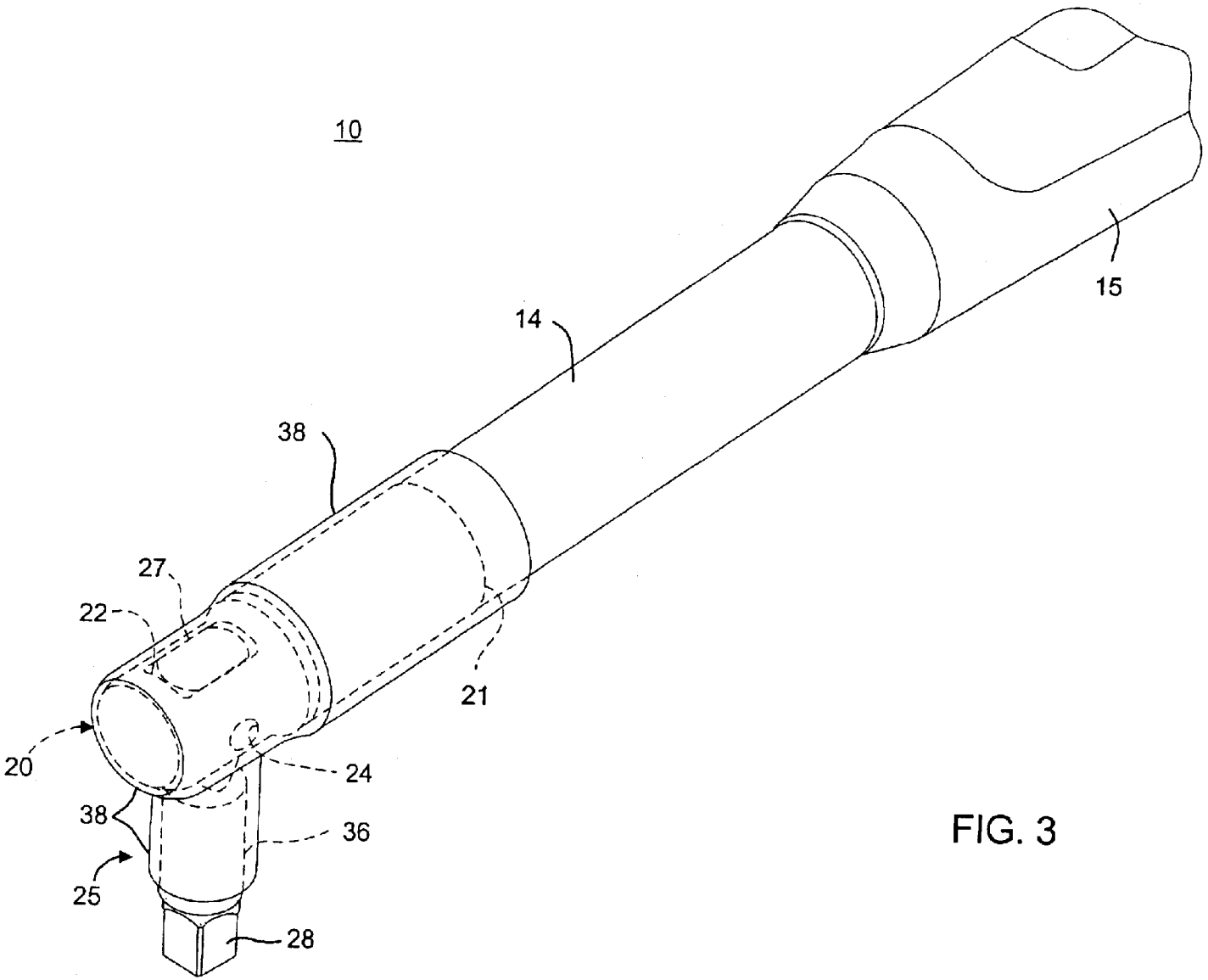
FIG. 3 is an enlarged, fragmentary, perspective view of the torque wrench of FIG. 1 with a protective boot added.

Mounted to the working end 12 of the shaft 14 is a yoke, generally designated by the numeral 20, which has an elongated, substantially cylindrical body 21 (FIG. 3) telescopically received within the working end of the tubular shaft 14, and fixedly secured in place therein, as by screws 22 (FIG. 2). The body 21 may be provided with a circumferential flange against which is seated an O-ring 21*a* for sealing against the end of the shaft 14. Formed diametrically through the body 21 forwardly of the O-ring 21*a* is a slot 23, which is generally rectangular in transverse cross-section and has an axis substantially perpendicular to the plane of the display 18. Formed diametrically through the body 21 along an axis substantially perpendicular to that of the slot 23 and intersecting the slot 23 is a bore 24 (FIG. 3).

Mounted on the body 21 is an elongated head 25, which has a substantially cylindrical shank 26 provided at one end thereof with a reduced coupling end 27, which has flattened opposite sides so that it fits upwardly through the slot 23 with a predetermined clearance at the forward and rearward ends thereof. Shank 26 is provided at the opposite end thereof with a drive square 28, which may be provided with a suitable spring-loaded detent ball in a known manner. The coupling end 27 is pivotally coupled in the slot 23 by a pivot pin 29 extending through the bore 24 and through a complementary bore (not shown) in the coupling end 27. The end clearance between the coupling end 27 and the slot 23 permits a slight pivotal movement of the head 25 about the axis of the pivot pin 29, the total pivotal travel of the head 25 being less than forty-five degrees, the head 25 being illustrated in the drawings substantially at the midpoint of its pivotal range.

Figure 4:
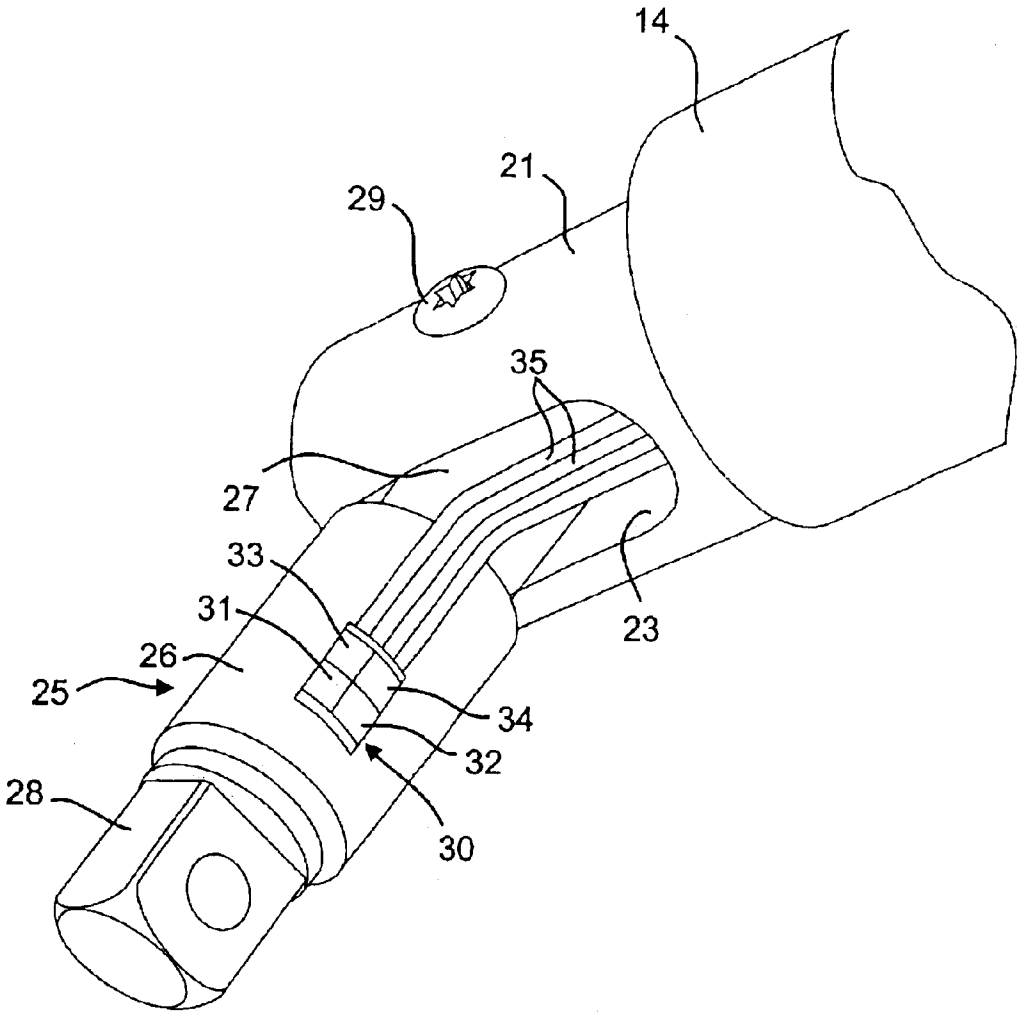
FIG. 4 is a fragmentary, perspective view of the underside of the working end of the torque wrench of FIG. 2, with a protective sleeve removed.

Referring in particular to FIG. 4, there is mounted on the rear side of the head shank 26 a strain gauge assembly 30, which may be of the type disclosed in the aforementioned copending application Ser. No. 10/293,006. The assembly 30 includes four gauges arranged in a bridge network, including two deflection sensing gauges 31 and 32 and Poisson correction and temperature compensation gauges 33 and 34. The terminal strips of the gauge assembly are connected via ribbon wires 35 to electronics in housing 15, the wires 35 extending upwardly into the lower end of the slot 23 and then rearwardly, longitudinally of the body 21, along a suitable channel (not shown). A cylindrical sheath or sleeve 36 may be provided in surrounding relationship with the shank 26, covering the strain gauge assembly 30 and protecting it in use, the sheath 36 being formed of any suitable material, such as a suitable elastomeric material. A flexible and resilient boot 38 may be provided for enclosing the working end 12 of the shaft 14, the O-ring 21*a* and the portion of the body 21 projecting from the shaft 14, as well as the head 25 down to the drive square 28. The boot 38 (FIG. 3) may be of unitary, one-piece construction and may be formed of a suitable rubber or elastomeric material and will protect the yoke 20, and particularly the pivot assembly thereof, from dust, dirt and the like, as well as protecting the yoke from potentially damaging contact with surrounding surfaces in use.

As was indicated above, the slot 23 is dimensioned to accommodate a slight pivoting forward and rearward movement of the head 25 to facilitate access to fasteners in certain applications. However, because the strain gauge assembly 30 is mounted on the head 25, it is always aligned in use with the rotational axis of the fastener being torqued, so that the relative angular position of the head 25 relative to the lever arm 11 has no effect on the value of the torque sensed by the strain gauge assembly 30.

Figure 5:
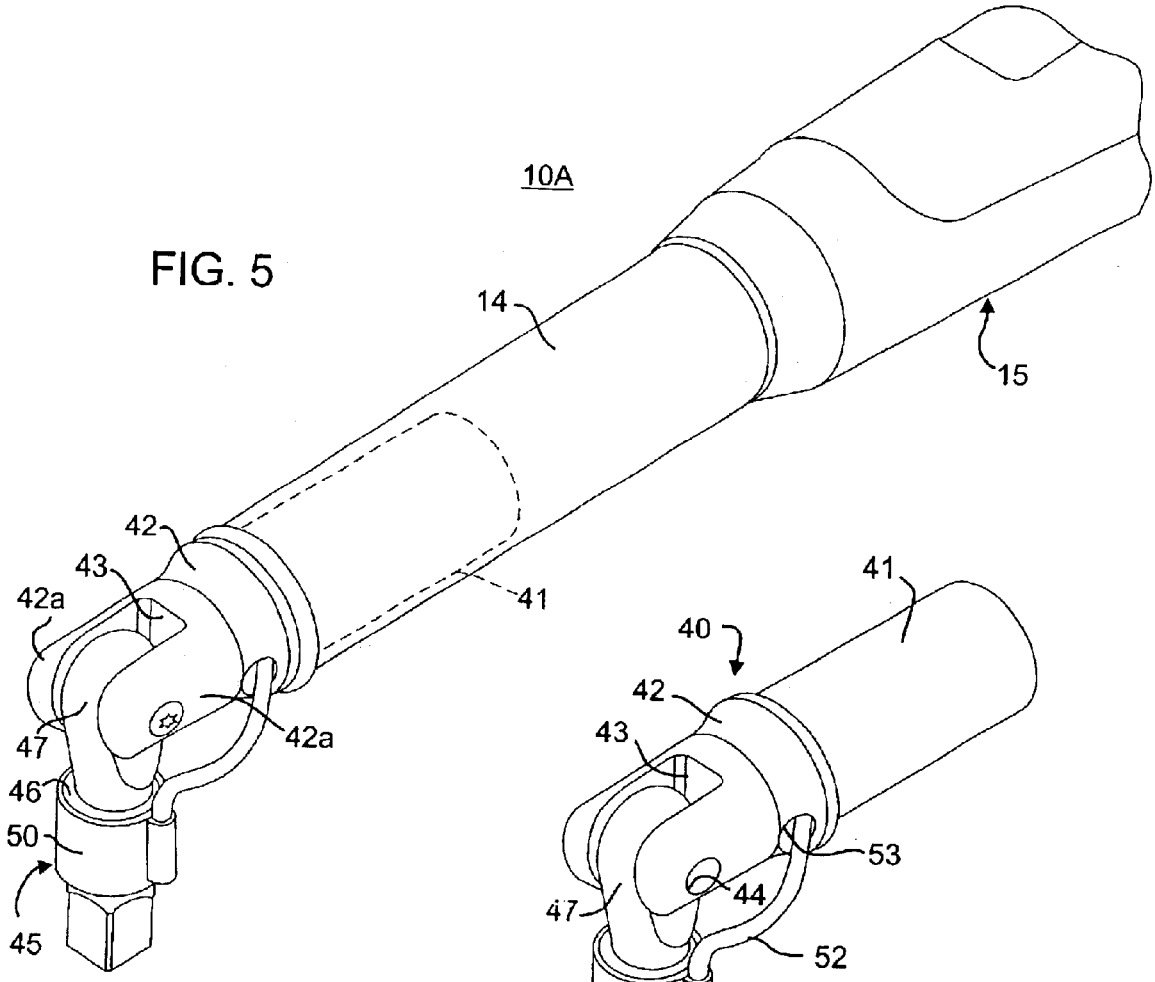
FIG. 5 is a view similar to FIG. 3 of an alternative torque wrench embodiment, with the protective boot removed.
Figure 6:
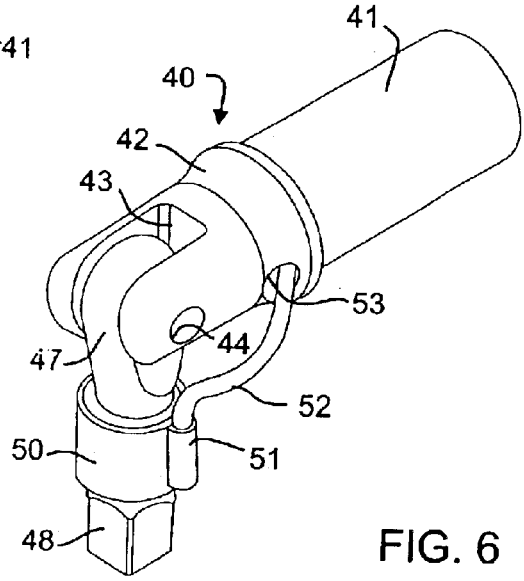
FIG. 6 is a perspective view of the yoke of the torque wrench of FIG. 5.
Figure 7:
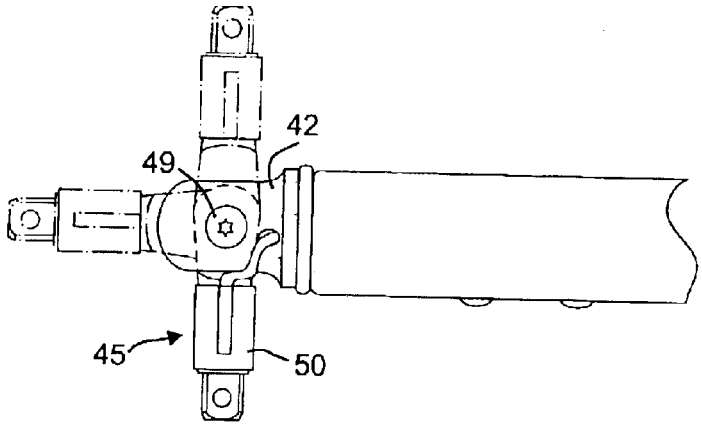
FIG. 7 is a reduced, fragmentary, side elevational view of the torque wrench of FIG. 5, illustrating different positions of the head.

Referring to FIGS. 5–7, there is illustrated another embodiment of electronic torque wrench, generally designated 10A, which is substantially the same as the torque wrench 10, described above, except that, in place of the yoke 20, there is provided a yoke 40, having an elongated cylindrical body 41 telescopically received in the working end of the shaft 14 and secured in place by any suitable means. The yoke 40 differs from the yoke 20, described above, fundamentally in that its forward portion is in the form of a clevis 22, having legs 42A which cooperate to define therebetween a slot 43. Diametrically aligned bores 44 extend through the arms 42*a*. The yoke 40 is provided with a head 45 having a shank 46, integral at one end thereof with a coupling end 47 with flattened sides which extends into the slot 43 of the clevis 42. The shank 46 is integral at its opposite end with a drive square 48. A pivot pin 49 extends through the bores 44 and through a complementary bore (not shown) in the coupling end 47 for pivotally connecting the head 45 to the clevis 42. Because of the clevis nature of this coupling, it will be appreciated that the head 45 is capable of a pivotal movement through at least 180 degrees, as illustrated in FIG. 7.

The strain gauge assembly 30 may be mounted on the shank 46 of the head 45, preferably being mounted on a side thereof The strain gauge assembly and the shank 46 may be enclosed within a suitable sheath 50, having a sleeve portion 51 which encompasses the adjacent end of a suitable cable 52 providing electrical connection to the strain gauge assembly 30 and extending through a suitable hole 53 in the yoke 40 for connecting to the electronics in the housing 15, in a known manner. The side mounting of the strain gauge assembly 30 on the head 45 accommodates the full range of pivotal movement of the head 45 without having to provide an unduly large slack portion of the cable 52. It will be appreciated that, if desired, a suitable boot, like the boot 28 described above, could be provided for protecting the yoke 40. Again, it will be appreciated that, because the strain gauge assembly is mounted on the head 45, it remains in alignment with the rotational axis of the fastener being torqued, the sensed value of torque being substantially unaffected by the pivotal orientation of the head 45.

From the foregoing, it can be seen that there has been provided an improved electronic torque wrench with an indexable head, which provides sensed torque values which are unaffected by the orientation of the head relative to the lever arm of the wrench.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of applicants' contribution. The actual scope of the protection sought is intended to be defined in the following claims when viewed in their proper perspective based on the prior art.

What is claimed is:

1. A torque wrench comprising:

a lever arm having a handle end and a working end, a head member coupled to the working end of the lever arm and having an end portion disposed beyond the working end for pivotal movement relative to the lever arm among different working positions, and a torque sensing device carried by the end portion of the head member for movement therewith.

2. The torque wrench of claim 1, and further comprising, a coupling apparatus for coupling the head member to the lever arm for limited relative pivotal movement through an angle substantially less than ninety degrees.

3. The torque wrench of claim 1, and further comprising, a coupling apparatus for coupling the head member to the lever arm for relative pivotal movement through an angle substantially greater than ninety degrees.

4. The torque wrench of claim 3, wherein the coupling apparatus includes a clevis on the lever arm and a coupling portion on the head member straddled by the clevis and pivotally coupled thereto.

5. The torque wrench of claim 1, wherein the torque sensing device includes a strain gauge assembly.

6. The torque wrench of claim 5, wherein the end portion of the head member includes a shank and a drive lug, the torque sensing device being disposed on the shank.

7. The torque wrench of claim 6, and further comprising a sheath encompassing the shank and the torque sensing device thereon.

8. The torque wrench of claim 1, wherein the working end of the lever arm has a cavity therein, and further comprising coupling apparatus including a yoke receivable in the cavity and pivotally coupled to the head member.

9. A torque wrench comprising:

a lever arm having a handle end and a working end, a display device carried by the lever arm intermediate the ends, a head member coupled to the working end of the lever arm and having an end portion disposed beyond the working end for pivotal movement relative to the lever arm among different working positions, a torque sensing device carried by the end portion of the head member for movement therewith, and an electrical connection between the torque sensing device and the display device.

10. The torque wrench of claim 9, wherein the display device includes a digital electronic display.

11. The torque wrench of claim 9, and further comprising a control keypad carried by the lever arm for controlling operation of the display device.

12. The torque wrench of claim 9, and further comprising a coupling apparatus for coupling the head member to the lever arm for limited relative pivotal movement through an angle of less than ninety degrees.

13. The torque wrench of claim 9, and further comprising a coupling apparatus for coupling the head member to the lever arm for relative pivotal movement through an angle substantially greater than ninety degrees.

14. The torque wrench of claim 9, wherein the electrical connection includes electrical conductors extending inside the lever arm.

15. The torque wrench of claim 9, wherein the torque sensing device includes a strain gauge assembly.

16. A method for applying torque to a workpiece having a first axis of rotation, the method comprising:

providing a head member adapted to be coupled to the workpiece for rotation therewith about the first axis, providing a torque sensing means on the head member for movement therewith, and coupling to the head member a torque-applying lever arm so that the lever arm is moveable relative to the head member about a second axis inclined at a non-zero angle with respect to the first axis among a plurality of positions, whereby the relative angular inclination of the axes does not adversely affect the accuracy of the torque sensing.

17. The method of claim 16, and further comprising displaying the torque level sensed by the torque sensing means.

18. The method of claim 17, wherein the coupling includes providing a coupling structure permitting limited pivotal movement between the head member and the lever arm through an angle substantially less than ninety degrees.

19. The method of claim 17, wherein the coupling includes coupling the head member to the lever arm for relative pivotal movement through an angle substantially greater than ninety degrees.

20. The method of claim 16, and further comprising encapsulating the sensing means and associated portions of the head member.

21. A torque wrench comprising:

lever means having a handle end and a working end, head means for rotating a workpiece about a first axis, means coupling the head means to the working end of the lever means for pivotal movement relative to the lever means among different working positions about a second axis inclined at a non-zero angle with respect to the first axis, and torque sensing means carried by the head means for movement therewith.

22. A torque wrench comprising:

a lever arm having a handle end and a working end, a head member for rotating a workpiece about a first axis, apparatus coupling the head member to the working end of a lever arm for pivotal movement relative to the lever arm among different working positions about a second axis inclined at a non-zero angle with respect to the first axis, and torque-sensing means carried by the head member for movement therewith.

23. The torque wrench of claim 22, wherein the angle is substantially 90°.

24. The method of claim 16, wherein the angle is substantially 90°.

25. The torque wrench of claim 21, wherein the angle is substantially 90°.

* * * * *